US005631059A

United States Patent [19]

Liao

[11] Patent Number: 5,631,059

[45] Date of Patent: May 20, 1997

[54] ARTIFICIAL SHRUB OR TREE AND METHOD OF CONSTRUCTION THEREFOR

[76] Inventor: Chien H. Liao, 3918 Misty Morn, Sugarland, Tex. 77479

[21] Appl. No.: 459,525

[22] Filed: Jun. 2, 1995

[51] Int. Cl.[6] ..... A47G 33/06

[52] U.S. Cl. ..... 428/20; 428/99; 211/205

[58] Field of Search ..... 428/8, 20, 19, 428/17, 99; 211/196, 205

[56] References Cited

U.S. PATENT DOCUMENTS 3,829,349 8/1974 Hermanson ..... 428/20

*Primary Examiner*—Alexander Thomas

*Attorney, Agent, or Firm*—Bernard A. Reiter; Mark L. Berrier

[57] ABSTRACT

This invention pertains to an improved artificial shrub or tree and the method for constructing same. The invention improves upon all prior art artificial shrubs or trees by providing for a marketedly authentic series of branches which extend from the trunk or main body of the growth and improves upon all prior art structures through the use of an intermediate adapter shaped in the form of a branch which has its thickest end extending from the trunk and which becomes increasingly thinner as it approaches the cantilever end thereof. The adapter produces an authentic branch appearance in comparison to prior art branches which generally have little if any diminishing thickness extending from the supporting end and which are simply bluntly stuck into a bore in the trunk.

5 Claims, 1 Drawing Sheet

ARTIFICIAL SHRUB OR TREE AND METHOD OF CONSTRUCTION THEREFOR

BACKGROUND AND PRIOR ART

Artificial shrubs and/or trees are generally characterized by a main body or trunk from which branches and/or limbs extend. Typically the branches and/or limbs constitute a body of relatively constant thickness which extend from the trunk. Although the thickness of the branch and/or limb may occasionally diminish from the supported end to the cantilevered end there is lacking the authentic appearance of a real branch and/or limb. This is due to the fact that the branch and/or limb of the prior art is commonly affixed to the trunk in a relatively crude manner, such as by insertion thereof into a bore or hole drilled into or otherwise excavated from the trunk. A glue or some other form of adhesive commonly fixes the branch and/or limb in the bore when it is driven into the bore manually. Craftsmen skilled in this construction heretofore have ignored the crude appearance of a branch and/or limb extending from the trunk with a relatively constant thickness starting at the trunk and extending for some distance therefrom. In other words there is no gradual diminishment of the thickness from the base of the branch. The absence of an expanded base in the branch betrays and reveals the very crude and artificial appearance of the construction, thus identifying the shrub or tree as aesthetically false.

The reason for this deficiency in the appearance of prior art shrubs and trees is due to the fact that the solution to the problem is neither obvious nor easy. Although it is obvious that one cannot introduce a branch or limb having a continuously expanding thickness towards its base, as is naturally the form of a branch or limb, into a bore of constant diameter, if there is nothing obvious about the manner in which this problem can be overcome. Nor is there an obvious manufacturing technique for economically affixing an authentic branch or limb having a naturally looking expanded base and diminished cantilever end into the trunk or supporting branch on a massed produced, repetitive, and economical basis.

FIELD OF THE INVENTION

The present invention is directed to a new and improved method for affixing the branches or limbs of artificial shrubs and trees and the like to the trunk or supporting branches thereof. More particularly, the present invention is directed to not only an improved method and construction for affixing branches and limbs to trunks and/or other branches and limbs in an aesthetically pleasing and authentically appearing fashion but also to an aesthetically improved and genuine looking branch or limb. Still further, the present invention improves upon the prior art by obviating the inherent problem in affixing a branch or limb having an expanded base to a trunk or other branch or limb. Moreover there is shown herein an economic and quick and simple method for manufacturing artificial shrubs and trees which additionally are authentic looking, particularly with respect to those portions of the artificial shrubs or trees where the branches are connected to supporting branches or trunks. These and numerous other features and advantages of the invention will become more readily apparent upon a detailed description thereof and with reference to the claims and drawings herein wherein like numerals denote like parts in the several views and wherein:

DETAILED DESCRIPTION OF THE INVENTION

Figure 1:
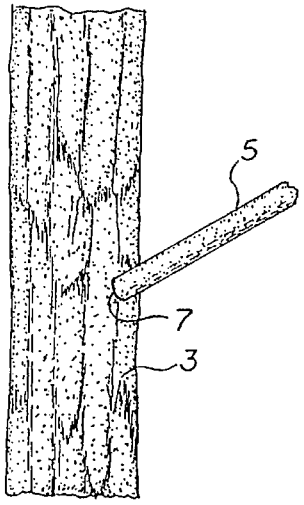
FIG 1 (PRIOR ART)
FIG. 1 is an illustration of the prior art showing a typical connection of a branch to the trunk.

In FIG. 1 there is shown an illustration of the present trunk 3 and branch 5 used in artificial shrubs and/or trees. The branch is inserted into a hole 7 drilled or otherwise made in the trunk of the tree. A form of adhesive may be inserted into the hole 7 prior to insertion of the branch 5. The adhesive and natural friction between the branch 5 and walls of the hole 7 hold the branch securely in position. One may observe the rather crude and "stuck-together" appearance which of course lacks authenticity in comparison to the appearance of real branches and limbs extending from real trunks or other branches and limbs.

Figure 2:
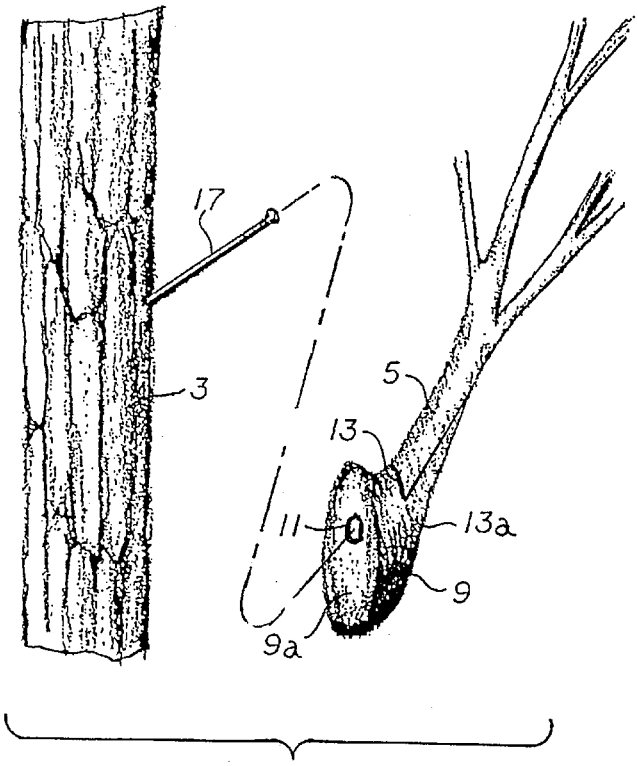
FIG. 2 is an exploded view showing an improved branch or limb having an adapter on the end thereof prior to insertion over a headless nail driven into the trunk.

In contrast, there is shown in FIG. 2 the structure of the invention. Here there is shown a trunk 3 which in actuality is a real trunk or thick branch of pre-selected diameter and predetermined length. An adapter 9 having a bore 11 extending therethrough is illustrated. The adapter 9 may be constructed from plastic or other appropriate material and is shaped to have a branch receiving slot 13 characterized by a circumferential wall 13*a*. The wall is preferably characterized by a diminishing thickness, (in cross section) extending from the base-end of the adapter to the distal end thereof so as to form a sleevelike distal end that merges gradually into the surface of the branch. The distal end of adapter 9 is intended to thus be described by a diameter across the circumference thereof that is slightly larger than the diameter of the branch 5 that fits there into.

The base 9*a* of adapter 9 is generally characterized by a circular or elliptical shape, in cross-section. For purposes of reality, the wall 13*a* is characterized by a center line (not shown) which is generally upwardly skewed in relation to the center line to the base 9*a*. This is because branches and limbs grow upwardly as opposed to horizontally, with respect to the ground. The bore 11 extending into the adapter 9 is drilled or otherwise molded into the adapter 9 at an angle consistent with or generally coaxial with the center line of the branch or limb 5 and may extend not only in and into and through the adapter 9 but also into a short distance of branch or limb 5.

Figure 3:
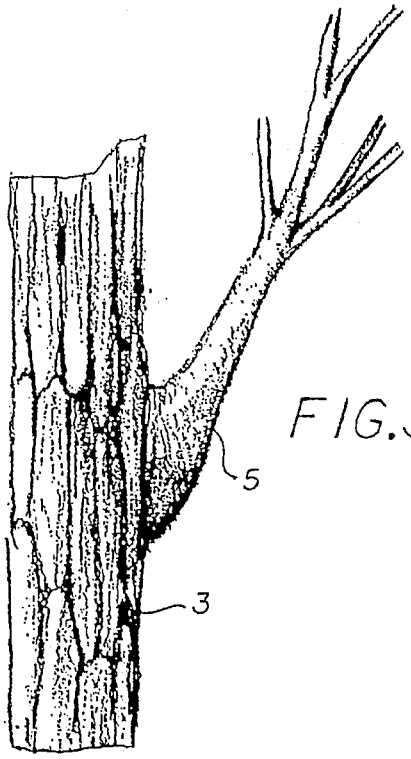
FIG. 3 shows an assembled view of the components illustrated in FIG. 2.
Figure 4:
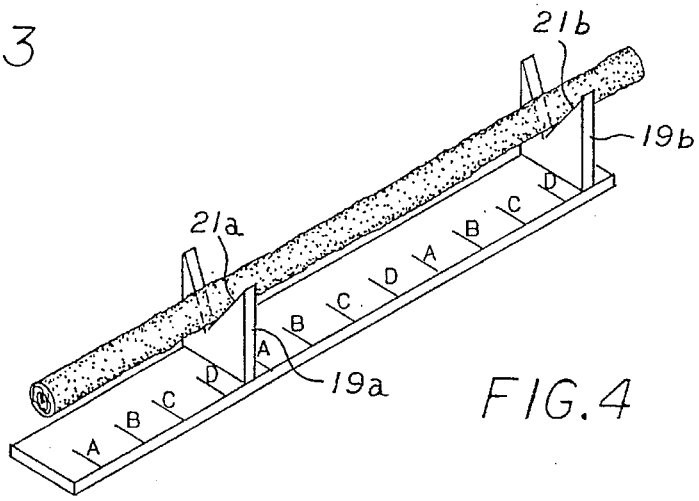
FIG. 4 shows a simple jig design for manufacturing of an artificial shrub or tree in accordance with the article and method of the invention.

A headless nail or other connective body 17 is used to affix the branch 5 to the trunk 3 (see FIGS. 2 and 3). The connective means 17 is simply driven into the trunk 3 at an upwardly directed angle with respect to the center line of the trunk (not shown). Thereafter the branch 5 having the aforedescribed adapter 9 affixed thereto is moved into position over the connective body 17 and slipped thereon to so that the headless nail is inserted into the bore 11 of adapter 9. The two bodies, that is branch or limb 5 and trunk 3 are thereafter pressed together so as to drive the connective body 17 up into the branch 5 thus resulting in a trunk and branch connection (FIG. 3) that is virtually indistinguishable from and constitutes an authentic replica of a real branch growing from a real trunk. In fact the branch is in fact a real branch (not living) and a real trunk (not living) with no or little visible means revealing the fact that the former is not the actual outgrowth of the latter.

In the manufacture of the above assembly a pre-selected trunk piece 3 is laid onto a jig. The trunk piece 3 extends over and past each of a pair of trunk supporting bridges 19*a*, 19*b* having notches 21*a*, 21*b* respectively extending downward from the upper ends thereof. The bridges 19*a*, 19*b* are fixed to a base 23. The base has a series of markings thereon at predetermined distances from one another, such as for example six inches, more or less. The branch is laid into the notches whereupon a craftsman proceeds to insert connective means 17 sequentially along the length of the trunk 3 through the use of an appropriate gun, or the like. The connective means 17 are inserted from one end to the next sequentially using the markers along the length of the base as guides for inserting the connective means 17. The first connective means 17 is inserted at a short distance from first bridge 19*a* at the letter A on the guide lines. After insertion of the first connective means 17, the trunk 3 is turned, ninety degrees more or less, before insertion of the second connective means 17 at the letter B. The third connective means 17 is thereafter inserted subsequent to turning of the trunk another ninety degrees more or less at the letter C. The process of insertion of the connective means 17 continues, each time the trunk being rotationally turned a predetermined number of degrees so as to thereby relatively evenly distribute the branch connections 5 around and along the length of the trunk. In this manner there is produced ultimately a shrub or tree having an appearance which is both similar to the natural growth of a real trunk and branches therefrom and is aesthetically pleasing in the overall distribution of branches and fullness of the tree or shrub in its entirety.

Therefore that which is claimed and desired to be secured by United States Letters Patent is:

1. In the trunk of a synthetic tree or shrub for supporting limbs or branches therefrom and in which the limbs or branches are characterized by a base and a distal end wherein the distal end is of a thinner cross sectional diameter than the base end, the improvement comprising an adapter having a rounded base to be affixed in abutting to the trunk, said adapter being characterized by a distal end having a cross sectional dimension substantially the same as the cross sectional dimension of the base end of the limb or branch, said distal end of the adapter being further characterized by a slot for receiving the branch therein, the base end of the adapter having a cross sectional dimension larger than the distal end thereof, and a connective means extending into the adapter and into the trunk for affixing the former to the latter in order to present an authentic and aesthetically pleasing appearance of a branch extending from a trunk.

2. The structure of claim 1 wherein the adapter is of generally frustro-conical shape and wherein said distal end slot is disposed substantially in the longitudinal axis and the limb or branch is characterized by a base end of reduced cross section, the base end of the branch being disposed in the frustro-conical distal end of the adapter.

3. The structure of claim 1 wherein the connective means consists of a nail driven into the trunk and extending outwardly therefrom and into the base end of said adapter.

4. The structure of claim 3 wherein the nail extending from the trunk and into the adapter extends into the base end of the branch to thereby fixedly engage the branch, adapter and trunk to one another in integral fashion.

5. The structure of claim 1 wherein a plurality of adapters and cooperating connective means are disposed in predetermined pattern along the length and circumference of the trunk, each affixing a branch into the distal end of each adapter slot.

* * * * *